US009575425B2

(12) United States Patent
Naka et al.

(10) Patent No.: US 9,575,425 B2
(45) Date of Patent: Feb. 21, 2017

(54) TONER

(71) Applicant: CANON KABUSHIKI KAISHA, Tokyo (JP)

(72) Inventors: Takeshi Naka, Suntou-gun (JP); Kazuo Terauchi, Numazu (JP); Motohide Shiozawa, Mishima (JP); Yojiro Hotta, Mishima (JP); Shohei Tsuda, Suntou-gun (JP); Katsuhisa Yamazaki, Numazu (JP); Koji Nishikawa, Susono (JP); Takayuki Itakura, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/446,286

(22) Filed: Jul. 29, 2014

(65) Prior Publication Data

US 2015/0037719 A1 Feb. 5, 2015

(30) Foreign Application Priority Data

Jul. 31, 2013 (JP) ..... 2013-158912

(51) Int. Cl.
*G03G 9/083* (2006.01)
*G03G 9/097* (2006.01)

(52) U.S. Cl.
CPC ..... *G03G 9/0838* (2013.01); *G03G 9/0836* (2013.01); *G03G 9/0837* (2013.01); *G03G 9/09716* (2013.01)

(58) Field of Classification Search
CPC . G03G 9/0831; G03G 9/09783; G03G 9/0834
See application file for complete search history.

(56) References Cited

U.S. PATENT DOCUMENTS

2003/0122911 A1* 7/2003 Mizoo ..... G03G 9/0819 347/95
2009/0047043 A1* 2/2009 Dojo et al. ..... 399/252
2013/0344430 A1 12/2013 Terauchi et al.
(Continued)

FOREIGN PATENT DOCUMENTS

JP 2005-3726 A 1/2005
JP 2005-202131 A 7/2005
WO 2013/063291 A1 5/2013

OTHER PUBLICATIONS

Machine English langauge translation of JP 2005202131, Jul. 28, 2005.*

(Continued)

*Primary Examiner* — Hoa V Le
(74) *Attorney, Agent, or Firm* — Fitzpatrick, Cella, Harper & Scinto

(57) ABSTRACT

A toner is provided including large particle-diameter external additives with sweep to the concaves of a toner particle suppressed, so that the large particle-diameter external additives function as spacer particles for a long period. The toner includes toner particles which contain a binder resin and magnetic material, and organic-inorganic composite fine particles having a structure including inorganic fine particles embedded in a vinyl resin particle. The presence state of the magnetic material on the toner particle surface satisfies specific conditions and the presence state of the organic-inorganic composite fine particles on the toner surface satisfies specific conditions.

8 Claims, 5 Drawing Sheets

(56) References Cited

U.S. PATENT DOCUMENTS

| | | | | |
|---|---|---|---|---|
| 2014/0099578 | A1 | 4/2014 | Hotta et al. | |
| 2014/0295341 | A1* | 10/2014 | Fomitchev et al. | 430/108.22 |
| 2015/0037720 | A1* | 2/2015 | Tsuda et al. | 430/108.3 |
| 2015/0037723 | A1* | 2/2015 | Nishikawa et al. | 430/108.6 |
| 2015/0037726 | A1* | 2/2015 | Nomura et al. | 430/109.1 |

OTHER PUBLICATIONS

Abstract of JP 4109928, Jul. 2, 2008.*
Abstract of JP 2004078055, Mar. 11, 2004.*
U.S. Appl. No. 14/341,084, filed Jul. 25, 2014. Inventor(s): Nishikawa, et al.
U.S. Appl. No. 14/339,689, filed Jul. 24, 2014. Inventor(s): Nomura, et al.

* cited by examiner

TONER

BACKGROUND OF THE INVENTION

Field of the Invention

The present invention relates to a toner for use in an electrophotographic method, an electrostatic recording method, a magnetic recording method and the like.

Description of the Related Art

At present, one component development method using a magnetic toner is widely employed in a copying machine and a laser beam printer, due to cost advantage and simple configuration of devices.

The magnetic toner is usually manufactured by a pulverization method, having an average circularity of 0.960 or less and a toner surface with irregularities in many cases.

At present, various investigations on both of the toner and the main unit are under way for further prolonged life of a copying machine and a printer which use the magnetic toner.

Examples of the effects of expected prolonged life in an electrophotographic system configuration on a toner include a prolonged agitation time for the toner in a toner container due to prolonged life. Accordingly, the physical load on the toner increases.

The increase in physical load on a toner in a process accelerates the embedding of small particle-diameter external additives existing on the toner surface into the toner surface, resulting in the occurrence of phenomena such as reduction in the flowability of toner, degradation in charging characteristics, and increase in physical adhesion. Eventually, image defects, density reduction and the like may be caused in some cases.

Conventional small particle-diameter external additives have not sufficiently solved the problems. The reason is that the governing factor of embedding of external additives into the toner surface is the particle diameter of the additives. As a logical sequence, the smaller the particle diameter is, the more easily the additives are embedded.

Accordingly, many attempts to use larger particle-diameter external additives as spacer particles have been conventionally made in dealing with the prolonged life.

Since large particle-diameter external additives have a large contact area with the toner surface, the impulse to the toner per unit surface area can be reduced. Consequently, embedding into the toner surface can be suppressed compared to small particle-diameter external additives.

For example, in Japanese Patent Application Laid-Open No. 2005-3726, large particle-diameter silica particles are added as external additives with expectation of suppression of embedding and prolongation of the life to a certain extent. In Japanese Patent Application Laid-Open No. 2005-202131, composite particles of small particle-diameter silica and large particle-diameter melamine resin particles are used as external additives.

However, the addition of large particle-diameter external additives to toner particles having a surface with irregularities may cause the large particle-diameter external additives to be swept to the concaves on the surface of a toner particle, resulting in an uneven distribution as shown in FIG. 1A.

The uneven distribution of the large particle-diameter external additives swept to the concaves on the surface of a toner particle may cause difficulty in achieving a prolonged life in some cases, though added for prolongation of life, since they cannot perform their inherent function as the large particle-diameter external additives as spacer particles. The reduction in adhesion to the toner surface due to the enlargement of particle diameter easily allows for detachment from the toner, causing a further problem that components are markedly contaminated therewith during long-term use.

In dealing with the problems, for example, International Publication No. WO 2013/063291 discloses an example of using an organic-inorganic composite fine particle as a spacer particle including inorganic fine particles fixed to the surface of an organic fine particle.

Since the organic-inorganic composite fine particle has convexes derived from the inorganic fine particles on the surface, the convexes as wedge is driven into the toner surface. Consequently, the organic-inorganic composite fine particles are hardly swept to the concaves on the surface of a toner particle to form an uneven distribution as shown in FIG. 1B, as compared to conventional spherical large particle-diameter external additives.

As a result of investigation by the present inventor, however, the effectiveness in not necessarily achieved, depending on the type of magnetic material of toner particles. In some cases, the organic-inorganic composite fine particles are swept to the concaves on the surface of a toner particle to form an uneven distribution as similar to conventional large particle-diameter external additives.

As described above, although the addition of large particle-diameter external additives is effective for achieving a prolonged life, there exist many negative effects which require further countermeasures.

SUMMARY OF THE INVENTION

The present invention is directed to providing a toner capable of solving the problems described above.

In other words, the present invention is directed to providing a toner with which large particle-diameter external additives are hardly swept to the concaves on the surface of a toner particle thereby preventing an uneven distribution, so that the large particle-diameter external additives can stay functioning as spacer particles to achieve a prolonged life.

According to one aspect of the present invention, there is provided a toner comprising a toner particle comprising a binder resin and magnetic material, and organic-inorganic composite fine particles; the toner particle having an average circularity of 0.960 or less; wherein each of the organic-inorganic composite fine particles comprises: a vinyl resin particle, and inorganic fine particles embedded to the vinyl resin particle, and the organic-inorganic composite fine particles have convexes derived from the inorganic fine particles on surfaces thereof, a number average particle diameter ranging from 50 nm to 200 nm, and a shape factor SF-2 ranging from 103 to 120, wherein: when drawing a first circle on a reflection electron image of the toner particle, the reflection electron image being photographed by using a scanning electron microscope with a magnifying power of 20,000, the first circle having a radius of 2.0 μm, and having a center at a midpoint of the maximum diameter of the toner particle in the reflection electron image, and dividing the first circle into eight regions evenly with eight lines each of which extends from the center of the first circle towards a periphery of the first circle, each of the eight regions comprises pieces of the magnetic material, and average number of the pieces of the magnetic material contained in each of the eight regions is 6.0 or more, and a coefficient of variation of the number of the pieces of the magnetic material among the eight regions is 0.50 or less; and wherein: when drawing a second circle on a reflection electron image of the toner, the reflection electron image being photographed by using a scanning electron microscope with a magnifying power of 20,000, the second circle having a radius of 2.0 μm, and having a center at a midpoint of the maximum diameter of the toner in the reflection electron image, and dividing the second circle into eight regions evenly with eight lines each of which extends from the center of the second circle towards a periphery of the second circle, each of the eight regions comprises the organic-inorganic composite fine particles, and average number of the organic-inorganic composite fine particles contained in each of the eight regions is 70.0 or more, and a coefficient of variation of the number of the organic-inorganic composite fine particles among the eight regions is 0.30 or less.

According to the present invention, even with the addition of the large particle-diameter external additives of organic-inorganic composite fine particles to toner particles having a surface with irregularities, the organic-inorganic composite fine particles are hardly swept to the concaves on the surface of a toner particle, thereby preventing an uneven distribution.

Consequently, the large particle-diameter external additives can perform the inherent function as spacer particles, so that a toner having a prolonged life can be provided.

Further features of the present invention will become apparent from the following description of exemplary embodiments with reference to the attached drawings.

DESCRIPTION OF THE EMBODIMENTS

Figure 1A:
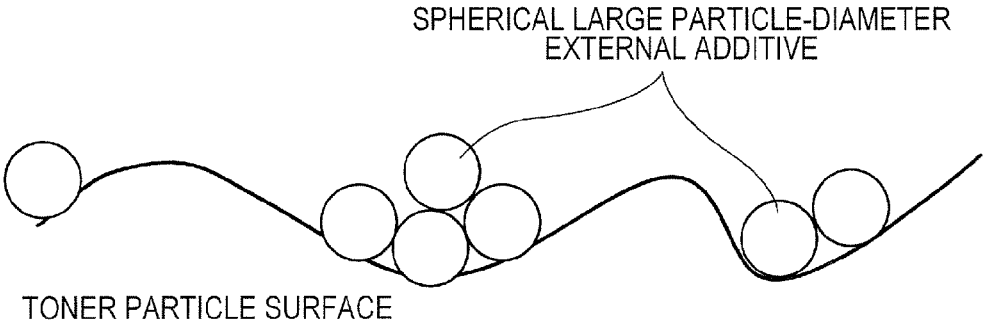
FIGS. 1A, 1B and 1C are schematic views illustrating aspects of spherical large particle-diameter external additives and organic-inorganic composite fine particles on the surface of a toner particle.

Preferred embodiments of the present invention will now be described in detail in accordance with the accompanying drawings.

The toner of the present invention including a toner particle including a binder resin and magnetic material, and organic-inorganic composite fine particles;

the toner particle having an average circularity of 0.960 or less; wherein each of the organic-inorganic composite fine particles includes:

a vinyl resin particle, and inorganic fine particles embedded to the vinyl resin particle, and the organic-inorganic composite fine particles have convexes derived from the inorganic fine particles on surfaces thereof, a number average particle diameter ranging from 50 nm to 200 nm, and a shape factor SF-2 ranging from 103 to 120, wherein:

when drawing a first circle on a reflection electron image of the toner particle, the reflection electron image being photographed by using a scanning electron microscope with a magnifying power of 20,000, the first circle having a radius of 2.0 μm, and having a center at a midpoint of the maximum diameter of the toner particle in the reflection electron image, and dividing the first circle into eight regions evenly with eight lines each of which extends from the center of the first circle towards a periphery of the first circle, each of the eight regions includes pieces of the magnetic material, and average number of the pieces of the magnetic material contained in each of the eight regions is 6.0 or more, and a coefficient of variation of the number of the pieces of the magnetic material among the eight regions is 0.50 or less; and wherein:

when drawing a second circle on a reflection electron image of the toner, the reflection electron image being photographed by using a scanning electron microscope with a magnifying power of 20,000, the second circle having a radius of 2.0 μm, and having a center at a midpoint of the maximum diameter of the toner in the reflection electron image, and dividing the second circle into eight regions evenly with eight lines each of which extends from the center of the second circle towards a periphery of the second circle, each of the eight regions includes the organic-inorganic composite fine particles, and average number of the organic-inorganic composite fine particles contained in each of the eight regions is 70.0 or more, and a coefficient of variation of the number of the organic-inorganic composite fine particles among the eight regions is 0.30 or less.

The toner particle of the present invention has an average circularity of 0.960 or less and a surface having irregularities. The circularity is an index for the degree of irregularities on a particle surface. The value of a perfect circle is 1.000, and the value is reduced by the presence of many irregularities. The toner particle can have the average circularity of 0.935 or more, from the viewpoints of satisfactory transfer property.

The large particle-diameter external additive for use in the present invention is formed of organic-inorganic composite fine particles having the following features.

1) Each of the organic-inorganic composite fine particles comprises a vinyl resin particle, and inorganic fine particles embedded to the vinyl resin particle.

2) The organic-inorganic composite fine particles have convexes derived from the inorganic fine particles on surfaces thereof.

3) The organic-inorganic composite fine particles have a number-average particle diameter of 50 nm or more and 200 nm or less.

4) The organic-inorganic composite fine particles have a shape factor SF-2 of 103 or more and 120 or less.

As described above, since the organic-inorganic composite fine particle has convexes derived from inorganic fine particles on the surface, the convexes as wedges are easily driven into the toner surface. The organic-inorganic composite fine particles are hardly swept to the concaves on the surface of a toner particle to form an uneven distribution compared to conventional spherical large particle-diameter external additives.

Figure 1B:
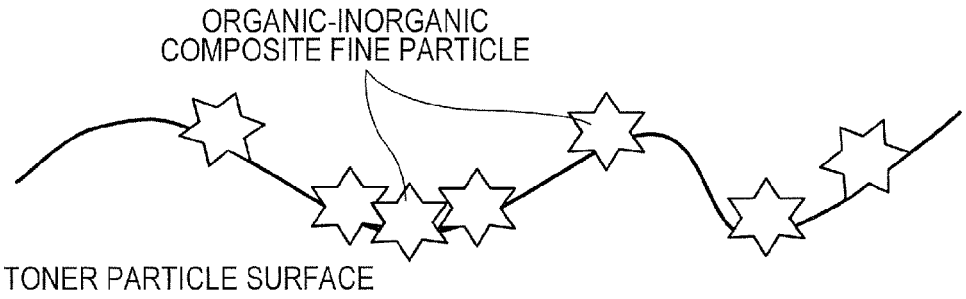

As a result of investigation by the present inventor, it was, however, found that the organic-inorganic composite fine particles are swept to the concaves on the surface of a toner particle to form an uneven distribution as similar to conventional large particle-diameter external additives in some cases (FIG. 1B).

For a further prolonged life of a copying machine and a printer, it is important to externally add the organic-inorganic composite fine particles more evenly onto the surface of a toner particle and to more effectively prevent detachment from the toner.

Figure 1C:
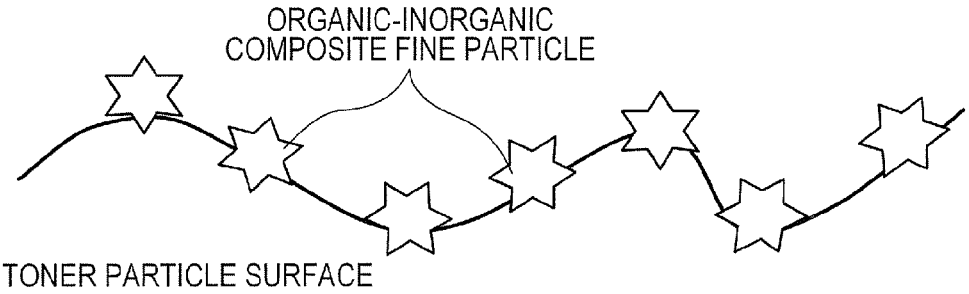
Figure 2:
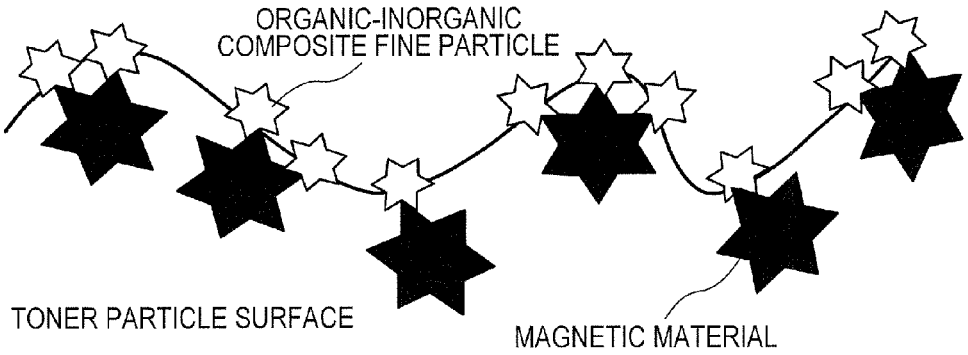
FIG. 2 is a schematic view illustrating an aspect of magnetic materials and organic-inorganic composite fine particles on the surface of a toner particle.

As a result of investigation for obtaining a toner having the organic-inorganic composite fine particles more evenly added externally to the surface of a toner particle regardless of irregularities on the surface of a toner particle as shown in FIG. 1C, the present inventor found that the presence state of magnetic materials on the surface of a toner particle is important.

More specifically, when drawing a first circle on a reflection electron image of the toner particle, the reflection electron image being photographed by using a scanning electron microscope with a magnifying power of 20,000, the first circle having a radius of 2.0 μm, and having a center at a midpoint of the maximum diameter of the toner particle in the reflection electron image, and dividing the first circle into eight regions evenly with eight lines each of which extends from the center of the first circle towards a periphery of the first circle, it is important that each of the eight regions comprises pieces of the magnetic material, and average number of the pieces of the magnetic material contained in each of the eight regions is 6.0 or more, and a coefficient of variation of the number of the pieces of the magnetic material among the eight regions is 0.50 or less.

It was found that when the organic-inorganic composite fine particles are externally added to the toner particles with an average number of magnetic material of 6.0 or more and a coefficient of variation of the number of magnetic material of 0.50 or less, irregularities on the surface of a toner particle hardly affect and the organic-inorganic composite fine particles can exist in a further evenly distributed state.

In the present invention, the presence state of magnetic materials on the surface of a toner particle is confirmed by a scanning electron microscope.

Figure 3:
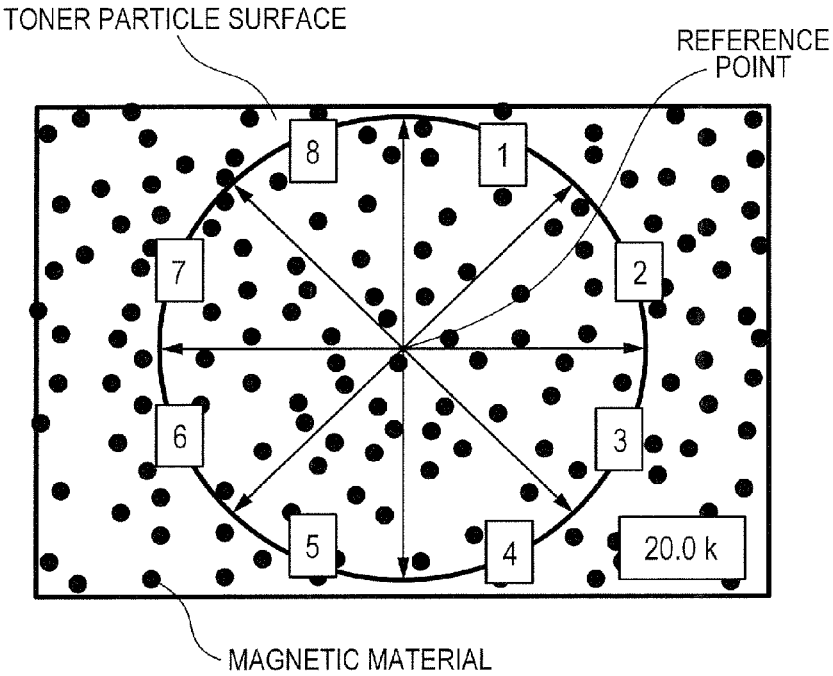
FIG. 3 is a schematic view illustrating an aspect of magnetic materials observed in the present invention in each of the eight regions of a circle having a radius of 2.0 μm drawn around a reference point, i.e. the midpoint of the maximum diameter of a toner particle in the reflection electron image photographed using a scanning electron microscope with a magnifying power of 20,000, divided into eight by lines extending from the reference point toward the periphery of the toner particle at 45° intervals.

More specifically, as shown in FIG. 3, the toner particle in the reflection electron image is photographed by a scanning electron microscope with a magnifying power of 20,000. The photographed image is imported into an image processing software. In the imported image, a toner particle in full view is selected as the object to be measured. The maximum diameter of the target toner particle is obtained to set a center (i.e. REFERENCE POINT in FIG. 3) at the midpoint. A circle having a radius of 2.0 μm is drawn around the center.

Subsequently, the circle on the reflection electron image of the toner particle photographed with a magnifying power of 20,000 is divided into eight regions evenly with eight lines extending from the center toward the periphery of the toner particle at 45° intervals. In each of the regions divided into eight, the number of observed pieces of the magnetic material is counted to calculate the average. Furthermore, a coefficient of variation of the number of pieces of the magnetic material among the eight regions is calculated. The coefficient of variation of the number of pieces of the magnetic material is calculated by a following formula.

The coefficient of variation=(Standard deviation of the number of pieces of the magnetic material among the eight regions/an average number of pieces of the magnetic material in the eight regions)

Each of 10 particles of the toner particles are measured by the above operation, and the averages calculated from the measurement are assumed to be "average number of the pieces of the magnetic material contained in each of the eight regions" and "coefficient of variation of the number of the pieces of the magnetic material among the eight regions" mentioned in claims, respectively. Herein, the pieces of the magnetic material are counted to calculate when 50% or more of the pieces of the magnetic material in the area of the pieces of the magnetic material are included in the region.

When the organic-inorganic composite fine particles are externally added to the toner particle having an average number of the magnetic material less than 6.0 or a coefficient of variation of the number of pieces of the magnetic material more than 0.50, the organic-inorganic composite fine particles are swept to concaves on the surface of a toner particle to form an undesirable uneven distribution. Herein, the average number of the pieces of the magnetic material can be 18.0 or less.

The organic-inorganic composite fine particles are further required to have a number-average particle diameter of 50 nm or more and 200 nm or less, so that the convexes on the surface of magnetic material and the convexes on the surface of organic-inorganic composite fine particles are geared.

It is believed that the organic-inorganic composite fine particles having a number-average particle diameter in the range tend to evenly attach to the surface of a toner particle, allowing the convexes on the surface of magnetic material and the convexes on the surface of organic-inorganic composite fine particles to be geared.

The organic-inorganic composite fine particles having a number-average particle diameter less than 50 nm are embedded under intense physical load due to electrophotographic process with a prolonged life, incapable of functioning as spacer particles.

The organic-inorganic composite fine particles having a number-average particle diameter larger than 200 nm, i.e. larger than the preferred number-average particle diameter of magnetic material to be described later, are not preferred, since the convexes of the surface of magnetic material and the convexes of organic-inorganic composite fine particles cannot be geared.

The organic-inorganic composite fine particles are further required to have a shape factor SF-2 of 103 or more and 120 or less measured with a scanning electron microscope.

The shape factor SF-2 is an index for the degree of irregularities of a particle. The value of a perfect circle is 100, and the degree of irregularities increases with the increase of the value.

The organic-inorganic composite fine particles having a shape factor SF-2 in the range allow for appropriate existence of the convexes derived from inorganic fine particles on the surface of organic-inorganic composite fine particles. The organic-inorganic composite fine particles thus tend to evenly attach to the surface of a toner particle. It is accordingly believed that the convexes on the surface of magnetic material and the convexes on the surface of organic-inorganic composite fine particles can be geared.

Herein, as the organic-inorganic composite fine particle mentioned above, the organic-inorganic composite fine particles described in International Publication No. WO 2013/063291 can be used, for example.

The present inventor further investigated a large particle-diameter external additive for inherently functioning as spacer particles to provide a toner having a prolonged life. It was accordingly found that the presence state of the organic-inorganic composite fine particles on the toner surface is important.

More specifically, when drawing a second circle on a reflection electron image of the toner, the reflection electron image being photographed by using a scanning electron microscope with a magnifying power of 20,000, the second circle having a radius of 2.0 μm, and having a center at a midpoint of the maximum diameter of the toner in the reflection electron image, and dividing the second circle into eight regions evenly with eight lines each of which extends from the center of the second circle towards a periphery of the second circle, it is important that each of the eight regions comprises the organic-inorganic composite fine particles, and average number of the organic-inorganic composite fine particles contained in each of the eight regions is 70.0 or more, and a coefficient of variation of the number of the organic-inorganic composite fine particles among the eight regions is 0.30 or less.

With an average number of the organic-inorganic composite fine particles of 70.0 or more and a coefficient of variation of the number of the organic-inorganic composite fine particles of 0.30 or less, the large particle-diameter external additives can inherently function as spacer particles, so that a toner having a prolonged life can be produced. Herein, the average number of the organic-inorganic composite fine particles can be 340.0 or less, preferably 180.0 or less.

In the present invention, the presence state of the organic-inorganic composite fine particles on a toner surface is confirmed by a scanning electron microscope.

Figure 4:
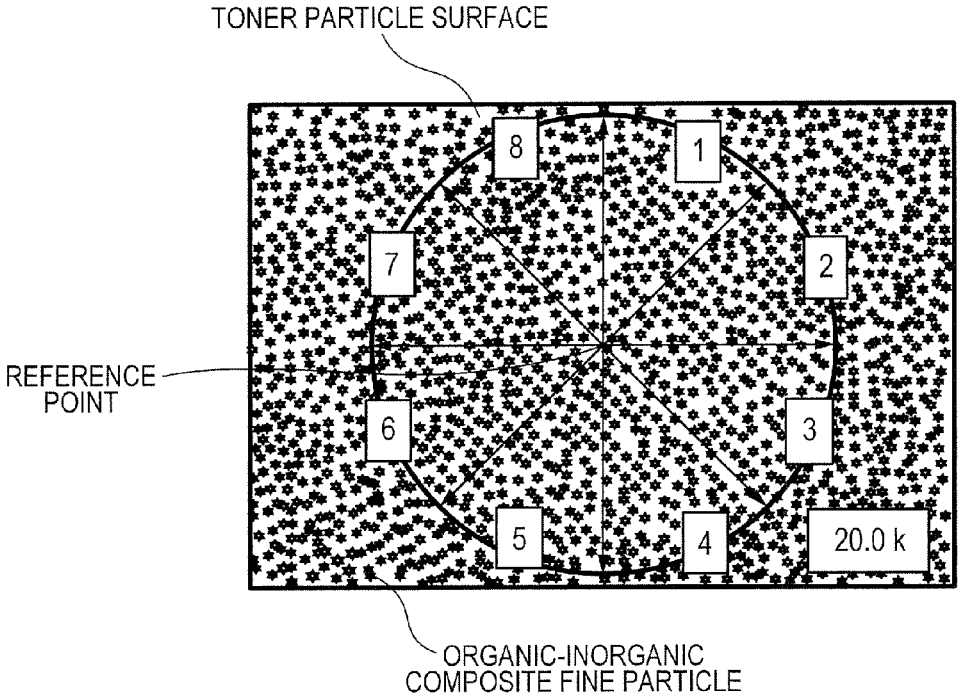
FIG. 4 is a schematic view illustrating an aspect of organic-inorganic composite fine particles observed in the present invention in each of the eight regions of a circle having a radius of 2.0 μm drawn around a reference point, i.e. the midpoint of the maximum diameter of a toner in the reflection electron image photographed using a scanning electron microscope with a magnifying power of 20,000, divided into eight by lines extending from the reference point toward the periphery of the toner at 45° intervals.

More specifically, as shown in FIG. 4, the toner in the reflection electron image is photographed by a scanning electron microscope with a magnifying power of 20,000. The photographed image is imported into an image processing software. In the imported image, a toner in full view is selected as the object to be measured. The maximum diameter of the target toner is obtained to set a center (i.e. REFERENCE POINT in FIG. 4) at the midpoint. A circle having a radius of 2.0 μm is drawn around the center.

Subsequently, the circle on the reflection electron image of the toner photographed with a magnifying power of 20,000 is divided into eight region evenly with eight lines extending from the center toward the periphery of the toner at 45° intervals. In each of the regions divided into eight, the number of the observed organic-inorganic composite fine particle is counted to calculate the average. Furthermore, a coefficient of variation of the number of the organic-inorganic composite fine particle among the eight regions is calculated. The coefficient of variation of the number of the organic-inorganic composite fine particles is calculated by a following formula.

The coefficient of variation=(Standard deviation of the number of the organic-inorganic composite fine particle among the eight regions/an average number of the organic-inorganic composite fine particle in the eight regions)

Each of 10 particles of the toners are measured by the above operation, and the averages calculated from the measurement are assumed to be "average number of the organic-inorganic composite fine particles contained in each of the eight regions" and "coefficient of variation of the number of the organic-inorganic composite fine particle among the eight regions" mentioned in claims, respectively. Herein, the organic-inorganic composite fine particle are counted to calculate when 50% or more of the organic-inorganic composite fine particle in the area of the organic-inorganic composite fine particle are included in the region.

With an average number of the organic-inorganic composite fine particles less than 70.0 or a coefficient of variation of the number of the organic-inorganic composite fine particles more than 0.30, the large particle-diameter external additives cannot perform the inherent function as spacer particles.

The amount of the organic-inorganic composites to be contained in a toner can be 0.5 parts by mass or more and 4.0 parts by mass or less based on 100 parts by mass of toner particles.

Figure 5:
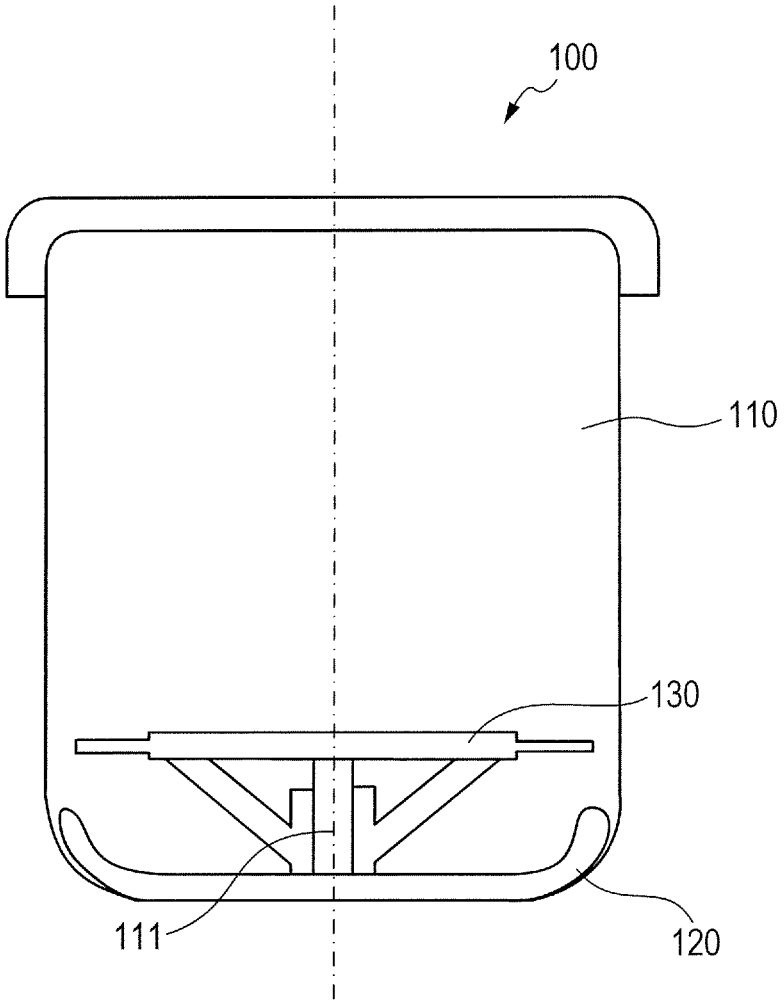
FIG. 5 is a schematic view illustrating an exemplary mixing processing device for use in external adding and mixing of the present invention.
Figures 6A, 6B:
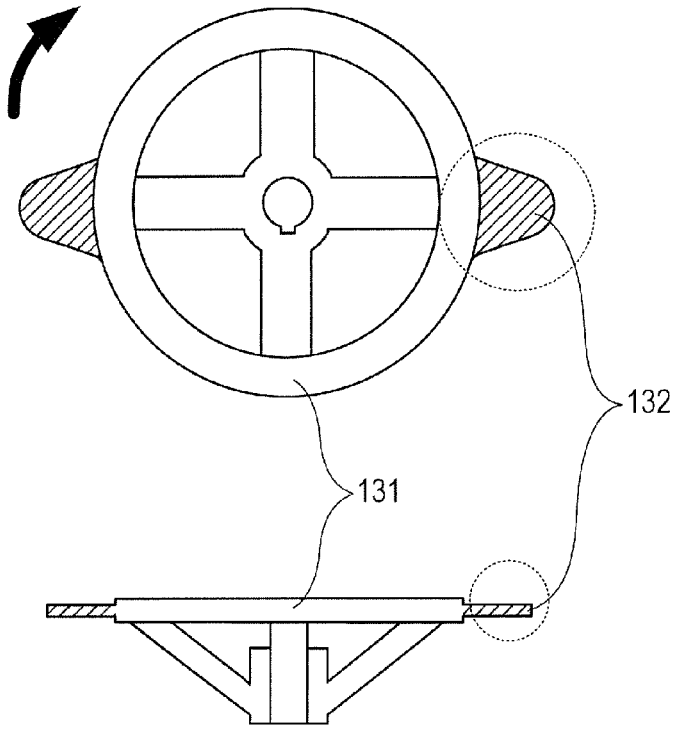
FIGS. 6A and 6B are schematic views illustrating an exemplary rotating body having a processing part in a mixing processing device of the present invention.

The average number and the coefficient of variation of the number of the organic-inorganic composite fine particles can be controlled within the range by, for example, devising the shape of a processing part 132 of a rotating body 130 in an external adding and mixing apparatus 100 shown in FIG. 5, FIG. 6A and FIG. 6B.

In addition, devising the shape of a processing part 132 of a rotating body 130 in an external adding and mixing apparatus 100 shown in FIG. 5, FIG. 6A and FIG. 6B prevents the organic-inorganic composite fine particles from being detached from the toner, capable of reducing the contamination of components in a long-term use.

In the present invention, the surfaces of the organic-inorganic composite fine particles can be covered with inorganic fine particles to have a coverage ratio of 20% or more and 70% or less. The surface coverage ratio within the range allows convexes derived from the inorganic fine particles to appropriately exist on the surface of the organic-inorganic composite fine particle. As a result, the convexes on the surface of magnetic material and the convexes on the surface of organic-inorganic composite fine particles can be geared. It is believed that the organic-inorganic composite fine particles are thereby hardly swept to the concaves on the surface of a toner particle to form an uneven distribution, so that a toner having a prolonged life can be produced.

In order to allow the magnetic material and the organic-inorganic composite fine particle to be geared, the magnetic material can be in a polyhedral shape, particularly in an octahedral shape.

The magnetic material in an octahedral shape allows the convexes on the surface of the magnetic material and the convexes on the surface of organic-inorganic composite fine particles to be geared, so that the organic-inorganic composite fine particles can be prevented from being swept to the concaves on the surface of a toner particle to form an uneven distribution.

It has been found that in order to form an even distribution of the magnetic materials on the surface of a toner particle, the number-average particle diameter of the magnetic material is important and particularly a small diameter is preferable. As a result of the investigation by the present inventor, the magnetic material can have a number-average particle diameter of 200 nm or less.

The magnetic materials having a number-average particle diameter of 200 nm or less can form an even distribution of the magnetic materials on the surface of a toner particle, so that the convexes on the surface of the magnetic material and the convexes of the surface of the organic-inorganic composite fine particles can be geared. Consequently, the organic-inorganic composite fine particles can be hardly swept to the concaves on the surface of a toner particle to form an uneven distribution. The magnetic materials can have a number-average particle diameter of 100 nm or more, from the viewpoints of dispersibility and the tinting power.

As described above, it is important that the average number of pieces and the coefficient of variation of the number of pieces of the magnetic materials, and the average number of pieces and the coefficient of variation of the number of pieces of the organic-inorganic composite fine particles satisfy the conditions described above.

The conditions described above allow the convexes on the surface of the magnetic material and the convexes on the surface of the organic-inorganic composite fine particles to be geared, preventing the organic-inorganic composite fine particles from being swept to the concaves on the surface of a toner particle to form an uneven distribution. It is believed that a toner having a prolonged life with excellent durability can be thereby produced.

The configuration of the toner of the present invention is described in the following.

A binder resin for use in the toner particles of the present invention is first described.

Examples of the binder resin include a polyester-based resin, a vinyl resin, an epoxy resin, and a polyurethane resin. From the viewpoint of storage stability, the binder resin preferably has a glass transition point (Tg) of 45° C. or more and 70° C. or less, more preferably 50° C. or more and 70° C. or less.

The toner of the present invention further contains magnetic materials so as to be used as a magnetic toner. In this case, the magnetic materials function also as colorant.

In the present invention, examples of the magnetic materials contained in a magnetic toner include an iron oxide such as magnetite, hematite and ferrite. Examples further include a metal such as iron, cobalt and nickel, or these metals and aluminum, cobalt, copper, lead, magnesium, tin, zinc, antimony, bismuth, calcium and manganese. Examples further include an alloy of titanium, tungsten and vanadium, and a mixture thereof.

The amount of the magnetic materials to be contained in a toner can be 45 parts by mass or more and 95 parts by mass or less based on 100 parts by mass of a binder resin.

The toner of the present invention may contain wax.

A charge control agent can be used to stabilize the electrostatic properties of the toner of the present invention. A charge control resin can also be used in combination with a charge control agent.

In manufacturing of the toner of the present invention, binder resin and magnetic materials as a colorant that constitute a toner particle, wax and other additives on an as needed basis are adequately mixed by a mixing machine such as Henschel mixer. The mixture is then melt kneaded by a heat kneader such as a biaxial kneading extruder, a heating roll, a kneader and an extruder, such that the resins are compatibilized with each other. Wax, magnetic materials and a metal-containing compound are dispersed or dissolved in the compatibilized resins. The melt is then cooled and solidified to be pulverized and classified. The toner particles of the present invention can be thus produced.

The present invention can include a surface modifying process for controlling the presence state of the magnetic materials on the surface of a toner particle, and controlling the shape of toner.

As a result of the investigation by the present inventor, it was found that the presence state of the magnetic materials on the surface of a toner particle can be controlled by controlling the force of mechanical impact in the surface modifying process. Although the reason is not clear, it is believed that the state of the magnetic materials driven into the surface of a toner particle is changed by the control of the force of mechanical impact. The surface modifying process may be performed either after pulverizing or after classification.

Alternatively, the toner of the present invention may be produced by adding organic-inorganic composite fine particles as external additive and a desired external additive other than the organic-inorganic composite fine particles on an as needed basis to toner particles and adequately mixing the mixture by a mixing machine such as Henschel mixer.

Examples of the mixing machine include: HENSCHEL MIXER (made by Nippon Coke & Engineering Co., Ltd.); SUPER MIXER (made by Kawata Mfg. Co., Ltd.); RIBBON CONE MIXER (made by Okawara Mfg. Co., Ltd.); and NAUTA MIXER and CYCLOMIX (made by Hosokawa Micron Corporation). Examples further include: SPIRAL PIN MIXER (made by Pacific Machinery & Engineering Co., Ltd.); and LOEDIGE MIXER (made by Matsubo Corporation).

Examples of the kneading machine include: KRC KNEADER (made by Kurimoto Ltd.); BUSS CO-KNEADER (made by Buss Inc.); TEM EXTRUDER (made by Toshiba Machine Co., Ltd.); TEX BIAXIAL KNEADER (made by Japan Steel Works, Ltd.); and PCM KNEADER (made by Ikegai Corporation). Examples further include: TRIARM ROLL MILL, MIXING ROLL MILL, and KNEADER (made by Inoue Mfg., Inc.); KNEADEX (made by Mitsui Mining Co., Ltd.); MS-TYPE PRESSURE KNEADER and KNEADER-RUDER (made by Moriyama Manufacturing); and BANBURY MIXER (made by Kobe Steel Ltd.).

Examples of the pulverizing machine include: COUNTER JET MILL, INOMIZER and GLACIS (made by Hosokawa Micron Corporation); IDS-TYPE MILL and PJM JET CRUSHER (made by Nippon Pneumatic Mfg. Co., Ltd.); and CROSS JET MILL (made by Kurimoto Ltd.). Examples further include: ULMAX (made by Nisso Engineering Co., Ltd.); SK JET-o-MILL (made by Seishin Enterprise Co., Ltd.); KRYPTRON (made by Earthtechnica Co., Ltd.); TURBO MILL (made by Freund-Turbo Corporation); and SUPER ROTOR (made by Nisshin Engineering Inc).

Examples of the classifier include: CLASSIEL, MICRON CLASSIFIER, and SPEDIC CLASSIFIER (made by Seishin Enterprise Co., Ltd.); and TURBO CLASSIFIER (made by Nisshin Engineering Inc.). Examples further include MICRON SEPARATOR, TURBO-PREX, TSP SEPARATOR and TTSP SEPARATOR (made by Hosokawa Micron Corporation); ELBOW-JET (made by Nittetsu Mining Co., Ltd.); and DISPERSION SEPARATOR (made by Nippon Pneumatic Mfg. Co., Ltd.).

Examples of the surface modification apparatus for use in a surface modifying process include: FACULTY, MECHANOFUSION and NOBILTA (made by Hosokawa Micron Corporation); and HYBRIDIZER (Nara Machinery Co., Ltd.). Among the devices, FACULTY (made by Hosokawa Micron Corporation) is suitable for use, allowing for simultaneous operations for surface modification and classification and easy control of the force of mechanical impact.

Examples of the sieve device used for riddling coarse particles include: ULTRASONIC (made by Koei Sangyo Co., Ltd.); RESONA-SIEVE and GYRO-SIFTER (made by Tokuju Corporation); and VIBRASONIC SYSTEM (Dalton Corporation). Examples further include SONICLEAN (made by Sintokogio Ltd.); TURBO SCREENER (made by Freund-Turbo Corporation); and MICROSIFTER (made by Makino Mfg. Co., Ltd.); and a circular vibration sieve.

Alternatively, the toner particles of the present invention may be manufactured in a water-based medium by, for example, a dispersion polymerization method, a dissolution suspension method and a suspension polymerization method.

The organic-inorganic composite fine particles for use in the present invention may be manufactured according to, for example, the Examples described in International Publication No. WO 2013/063291.

The number-average particle diameter and the shape of the organic-inorganic composite fine particles can be adjusted by changing the particle diameter of inorganic fine particles to compose the organic-inorganic composite fine particles and the quantitative ratio between the inorganic fine particles and the resin.

The toner of the present invention may include external additives other than the organic-inorganic composite fine particles. In particular, a fluidity improver can be added as other external additive for improving the fluidity and the electrostatic properties of the toner.

The measurement methods for each of physical properties of the toner of the present invention are described in the following.

Method of Confirmation of Aspects of Magnetic Material and Measurement Method for Number-Average Particle Diameter of the Magnetic Materials Aspects of magnetic material are confirmed with a scanning electron microscope "S-4800" (trade name, made by Hitachi, Ltd.). In a visual field under a magnifying power of 100,000 to 200,000, a magnetic material is observed. The number-average particle diameter of magnetic materials is measured with the scanning electron microscope "S-4800". In a visual field under a magnifying power of 100,000 to 200,000, a magnetic material is observed to randomly measure the maximum diameter of 100 pieces of primary particles of magnetic materials. The number-average particle diameter is calculated from a distribution of the maximum diameter obtained by the measurement. A magnetic material can be isolated from a toner by dissolving a binder rein included in the toner to a solvent which can dissolve the binder resin such as chloroform.

Measurement Method for Number-Average Particle Diameter of Organic-Inorganic Composite Fine Particles The number-average particle diameter of organic-inorganic composite fine particles is measured with a scanning electron microscope "S-4800" (trade name, made by Hitachi, Ltd.). In a visual field under a magnifying power of 200,000 at maximum, a toner externally added with organic-inorganic composite fine particles is observed to randomly measure the maximum diameter of 100 pieces of primary particles of organic-inorganic composite fine particles. The number-average particle diameter is calculated from a distribution of the maximum diameter obtained by the measurement. The observation magnifying power is properly adjusted depending on the size of the organic-inorganic composite fine particles.

Measurement Method of Shape Factor SF-2 of Organic-Inorganic Composite Fine Particles The shape factor SF-2 of organic-inorganic composite fine particles was calculated as follows, based on the observation of a toner externally added with the organic-inorganic composite fine particles with a scanning electron microscope "S-4800" (trade name, made by Hitachi, Ltd.).

In a visual field under a magnifying power of 100,000 to 200,000, a toner externally added with organic-inorganic composite fine particles is observed to calculate the boundary length and the area for 100 pieces of primary particles with an image processing software "Image-Pro Plus 5.1J" (made by Media Cybernetics, Inc.). The shape factors SF-2 calculated from the following formula are averaged to determine the shape factor SF-2 of the organic-inorganic composite fine particles.

$$\text{SF-2}=(\text{boundary length of particle})^2/(\text{area of particle})\times 100/4\pi$$

Measurement Method of Coverage Ratio of the Organic-Inorganic Composite Fine Particle Surface with Inorganic Fine Particles The coverage ratio of the surface of the organic-inorganic composite fine particle of the present invention with inorganic fine particles is measured with electron spectroscopy for chemical analysis (ESCA).

Herein, an example using silica as inorganic fine particle is described below.

A measurement method in the case of using silica as inorganic fine particle is described below.

(1) A silica particle is used as the measurement sample, and a Si amount (A) is measured.

(2) A organic-inorganic composite fine particle is used as the measurement sample, and a Si amount (B) is measured.

The coverage ratio of the surfaces of the organic-inorganic composite fine particles with inorganic fine particles is calculated by a following formula.

$$\text{The coverage ratio of the surfaces of the organic-inorganic composite fine particles with inorganic fine particles}=\text{Si amount }(B)/\text{Si amount }(A)\times 100$$

In the present measurement, sol-gel silica particles (number-average particle diameter of 110 nm) were used as silica particles for calculation. In the case of using an external additive of silica alone, the coverage ratio of silica is 100%. The resin particles without specific surface treatment have a coverage ratio of silica of 0%.

ESCA is an analysis method for detecting atoms in the region to several nm or less in the depth direction from the surface of a sample. The atoms in the surface of the organic-inorganic composite fine particle can be therefore detected.

As a sample holder, a 75 mm square accessory platen (having a screw hole with a diameter of about 1 mm for fixing a sample) of the apparatus was used.

The through screw hole in the platen is plugged with resin or the like to form a concave having a depth of about 0.5 mm for measurement of powder. A sample to be measured is filled in the concave with a spatula or the like and sliced off to prepare the sample.

The ESCA apparatus and the measurement conditions are as follows.

Apparatus for use: QUANTUM 2000 made by Ulvac-Phi, Inc.

Analysis method: Narrow analysis

Measurement conditions:

X-ray source: Al—Kα

X-ray conditions: beam diameter of 100 μm, 25 W, 15 kV

Photoelectron collection angle: 45°

Pass Energy: 58.70 eV

Measurement area: ϕ=100 μm

Measurements were performed under the conditions described above.

In the analysis method, the peak derived from the is orbital of carbon in a C—C bond is first corrected to 285 eV.

Based on the peak area derived from the 2 p orbital of silicon with a detected peak top of 100 eV or more and 105 eV or less, the amount of Si derived from silica relative to the total amount of constituent elements is then calculated using a relative sensitivity factor provided from Ulvac-Phi, Inc. In the case of using inorganic fine particles other than silica, except that "Si amount" is change to "amount of the inorganic element contained in the inorganic fine particles", this method can be used.

In the case of measuring the coverage ratio of the surface of an organic-inorganic composite fine particle, which externally added to toner, with inorganic fine particles, the organic-inorganic composite fine particles are isolated from the toner before measurement.

The method for isolating the organic-inorganic composite fine particles from the toner includes: ultrasonically dispersing the toner in ion exchange water for detachment of the organic-inorganic composite fine particles; leaving the dispersion liquid standing for 24 hours; and collecting the supernatant liquid to be dried.

Measurement Method of Weight-Average Particle Diameter (D4) of Toner Particle The weight-average particle diameter (D4) of toner particles is calculated as follows.

A precise particle size distribution measurement apparatus "COULTER COUNTER MULTISIZER 3" (registered trade mark, made by Beckman Coulter, Inc.) by pore resistance method is used as measurement apparatus, having a 100 μm aperture tube. An accompanying customized software "Beckman Coulter MULTISIZER 3 Version 3.51" (made by Beckman Coulter, Inc.) is used for setting measurement conditions and analyzing measurement data. The number of effective measurement channels in measurement is set to 25,000 channels. The aqueous electrolyte solution for use in measurement may be, for example, "ISOTON II" (made by Beckman Coulter, Inc.), having sodium chloride (special grade) dissolved in ion exchange water with a concentration of about 1% by mass.

Prior to measurement and analysis, the customized software is set to the following.

In a screen page "Change from standard measurement method (SOM)" of the customized software, the number of total count in control mode is set to 50,000 particles, the number of measurement is set to one, and the Kd value is set to a value obtained using "standard particles of 10.0 μm" (made by Beckman Coulter, Inc.). The threshold and the noise level are automatically set by pushing a "threshold/noise level measurement button". The current is set to 1,600 μA, the gain is set to 2, and the electrolyte is set to ISOTON II, and "Flushing aperture tube after measurement" is checked. In a screen page "Pulse to particle diameter conversion setting" of the customized software, the bin clearance is set to log particle diameter, the particle diameter bin is set to 256 particle diameter bin, and the particle diameter range is set to from 2 μm to 60 μm.

The specific measurement method is described in the following.

(1) A round-bottomed 250-mL glass beaker for exclusive use of Multisizer 3 is filled with the aqueous electrolyte solution in an amount of about 200 mL so as to be set on a sample stand. The solution is agitated with a stirrer rod at a rate of 24 revolutions per second in counterclockwise direction. Owing to the function "Flushing of aperture" of the customized software, the contamination and bubbles in the aperture tube are removed in advance.

(2) A flat-bottomed 100-mL glass beaker is filled with the aqueous electrolyte solution in an amount of about 30 mL. To the solution, a dispersant liquid in an amount of about 0.3 mL is added, including "CONTAMINON N" (10% by mass aqueous solution of neutral detergent with a pH of 7 for cleaning precise measurement devices, including a nonionic surfactant, an anionic surfactant, and an organic builder; made by Wako Pure Chemical Industries, Ltd.) diluted to about 3 times the mass with ion exchange water.

(3) An ultrasonic dispersion apparatus "ULTRASONIC DISPERSION SYSTEM TETORA 150" (made by Nikkaki Bios Co., Ltd.) with an electric output of 120 W is prepared, having two built-in oscillators with an oscillating frequency of 50 kHz, with 180 degree phase shift. The tank of the ultrasonic dispersion apparatus is filled with ion exchange water in an amount of about 3.3 L, into which CONTAMINON N in an amount of about 2 mL is added.

(4) The beaker described in (2) is set to the beaker fixing hole of the ultrasonic dispersion apparatus, and the ultrasonic dispersion apparatus is then actuated. The height position of the beaker is adjusted to achieve the maximum resonance state of the liquid level of the aqueous electrolyte solution in the beaker.

(5) In a state that the aqueous electrolyte solution in the beaker described in (4) is irradiated with ultrasonic waves, a toner particle in an amount of about 10 mg is added little by little to the aqueous electrolyte solution so as to be dispersed. The ultrasonic dispersion treatment is further continued for 60 seconds. In the ultrasonic dispersion, the water temperature in the tank is properly adjusted within the range of 10° C. or more and 40° C. or less.

(6) The aqueous electrolyte solution including dispersed toner particles described in (5) is dropped into the round-bottomed beaker set in a sample stand described in (1) with a pipette, such that the measured concentration is adjusted to about 5%. The measurement is continued until the number of measured particles reaches 50,000 pieces.

(7) The measurement data is analyzed with the accompanying customized software of the apparatus so as to calculate the weight-average particle diameter (D4). When the graph/volume % is set in the customized software, "average diameter" in the "analysis/volume statics (arithmetic average)" screen page is the weight-average particle diameter (D4).

Average Circularity of Toner Particles

The average circularity of toner particles is measured with a flow-type particle image analyzer "FPIA-3000" (made by Sysmex Corporation), under the measurement and analysis conditions for calibration.

A specific measurement method is described in the following. A glass vessel is first filled with ion exchange water in an amount of about 20 mL from which solid impurities are removed in advance. To the ion exchange water, a dispersant liquid in an amount of about 0.2 mL is added, including "CONTAMINON N" (10% by mass aqueous solution of neutral detergent with a pH of 7 for cleaning precise measurement devices, including a nonionic surfactant, an anionic surfactant and an organic builder; made by Wako Pure Chemical Industries, Ltd.) diluted to about 3 times the mass with ion exchange water. The sample to be measured in an amount of about 0.02 g is further added thereto, and dispersed with an ultrasonic dispersion apparatus for 2 minutes so as to produce a dispersion liquid for measurement. On this occasion, the dispersion liquid is properly cooled at a temperature of 10° C. or more and 40° C. or less.

A desktop type ultrasonic cleaner and disperser having an oscillation frequency of 50 kHz and an electric output of 150 W (e.g. "VS-150" made by Velvo-Clear Co.) may be used as ultrasonic dispersion apparatus. The water tank is filled with a predetermined amount of ion exchange water, into which the CONTAMINON N in an amount of about 2 mL is added.

In measurement, the flow type particle image analyzer mounted with "UPlanApro" (magnifying power: 10, and numerical aperture: 0.40) is used as objective lens, and a particle sheath "PSE-900A" (made by Sysmex Corporation) is used as sheath liquid.

The dispersion liquid prepared by the procedures is introduced to the flow type particle image analyzer, so that 3,000 pieces of toner particles are measured in the HPF measurement mode and in the total count mode. In particle analysis, the binarization threshold is set to 85%, and the particle diameter to be analyzed is limited to an equivalent circle diameter of 1.985 μm or more and less than 39.69 μm, so that the average circularity of the toner particle is obtained.

EXAMPLES

The following Examples and Comparative Examples are provided to describe the present invention in more detail but are not intended to limit the scope of the invention. All the numbers of parts in Examples and Comparative Examples are represented in unit of mass unless otherwise specified.

Manufacturing Example of Magnetic Toner Particles 1

Polyester resin: 100 parts

Magnetic iron oxide particles (number-average particle diameter: 200 nm, in octahedral shape): 60 parts Polyethylene wax (PW2000: made by Toyo Petrolite Co., melting point: 120° C.): 4 parts Charge control agent (T-77: made by Hodogaya Chemistry Co., Ltd.): 2 parts The materials were premixed with a Henschel mixer (FM20 made by Nippon Coke & Engineering Co., Ltd.), and then melt kneaded with a biaxial kneading extruder (TEM-26SS made by Toshiba Machine Co., Ltd.) to produce a kneaded product. The kneaded product was cooled, coarsely pulverized with a hammer mill (H-12 made by Hosokawa Micron Corporation), and then pulverized with a mechanical pulverizer (T-250 made by Freund-Turbo Corporation) to produce a finely pulverized product.

The finely pulverized product was classified with a multiple classifier (EJ-5 made by Nittetsu Mining Co., Ltd.) to produce a classified product, which was then surface-modified with a surface modification apparatus FACULTY (F400 made by Hosokawa Micron Corporation modified as described below) so as to produce magnetic toner particles 1.

In the surface modification of the present manufacturing example, the clearance between a hammer arranged on the periphery of a dispersion rotor and a liner on the periphery of the dispersion rotor was set to 3 mm, the circumferential velocity of the rotation of the dispersion rotor was set to 120 m/sec, the input of the classified product was set to 1.0 kg per cycle, and the surface modification time (i.e. cycle time from the completion of raw material feeding to the opening of a discharging valve) was set to 30 seconds. The temperature of cooling wind and the temperature of cooling water in jacket of the apparatus body were controlled such that the product temperature was kept at 35° C. when the particles are discharged.

The magnetic toner particles 1 produced through the processes had a weight average particle diameter (D4) of 7.0 μm and an average circularity of 0.942. In addition, the average number of pieces of the magnetic material was 11.8, and the coefficient of variation of the number of pieces of the magnetic material was 0.12. The physical properties are shown in Table 1.

Manufacturing Example of Magnetic Toner Particles 2

Except that the circumferential velocity of rotation of the dispersion rotor was changed to 140 m/sec and the temperature of cooling wind and the temperature of cooling water in jacket of the apparatus body were controlled in the surface modification, the magnetic toner particles 2 were obtained by the same way as the magnetic toner particles 1. The product temperature was kept at 40° C. when the particles were discharged from the surface modification apparatus. The physical properties of the magnetic toner particles 2 are shown in Table 1.

Manufacturing Example of Magnetic Toner Particles 3

Except that the circumferential velocity of rotation of the dispersion rotor was changed to 160 m/sec and the temperature of cooling wind and the temperature of cooling water in jacket of the apparatus body were controlled in the surface modification, the magnetic toner particles 3 were obtained in the same way as the magnetic toner particles 1. The product temperature was kept at 45° C. when the particles were discharged from the surface modification apparatus. The physical properties of the magnetic toner particles 3 are shown in Table 1.

Manufacturing Example of Magnetic Toner Particles 4

Except that magnetic materials (magnetic iron oxide particles) having a number-average particle diameter of 300 nm were used, the magnetic toner particles 4 were obtained as similar to the magnetic toner particles 3. The physical properties of the magnetic toner particles 4 are shown in Table 1.

Manufacturing Example of Magnetic Toner Particles 5

Except that spherical magnetic materials (magnetic iron oxide particles) having a number-average particle diameter of 300 nm were used, the magnetic toner particles 5 were obtained as similar to the magnetic toner particles 3. The physical properties of the magnetic toner particles 5 are shown in Table 1.

Manufacturing Example of Magnetic Toner Particles 6

Except that the temperature of cooling wind and the temperature of cooling water in jacket of the apparatus body were controlled to keep the product temperature at 50° C. when the particles were discharged from the surface modification apparatus in the surface modification, the magnetic toner particles 6 were obtained in the same way as the magnetic toner particles 5. The physical properties of the magnetic toner particles 6 are shown in Table 1.

TABLE 1

| | | Magnetic toner particle 1 | Magnetic toner particle 2 | Magnetic toner particle 3 | Magnetic toner particle 4 | Magnetic toner particle 5 | Magnetic toner particle 6 |
|---|---|---|---|---|---|---|---|
| Magnetic material | Shape | Octahedron | Octahedron | Octahedron | Octahedron | Spherical | Spherical |
| | Number-average particle diameter (nm) | 200 | 200 | 200 | 300 | 300 | 300 |
| | Average number of pieces | 11.8 | 9.3 | 7.5 | 6.5 | 6.2 | 5.2 |
| | Coefficient of variation of number of pieces | 0.12 | 0.20 | 0.26 | 0.34 | 0.48 | 0.53 |
| Weight-average particle diameter D4 of toner particles (μm) | | 7.0 | 7.0 | 7.0 | 7.0 | 7.0 | 7.0 |
| Average circularity of toner particles | | 0.942 | 0.948 | 0.955 | 0.955 | 0.955 | 0.962 |
| Circumferential velocity of rotating dispersion rotor of surface modification apparatus (m/sec) | | 120 | 140 | 160 | 160 | 160 | 160 |
| Temperature of particles discharged from surface modification apparatus (° C.) | | 35 | 40 | 45 | 45 | 45 | 50 |

Manufacturing Example of Organic-Inorganic Composite Fine Particles

Organic-inorganic composite fine particles 1 to 8 were prepared according to the Example 1 described in International Publication No. WO 2013/063291. As inorganic fine particles used in preparing the organic-inorganic composite fine particles, silica fine particles described in Table 2 were used. In preparing organic-inorganic composite fine particles 5, 6 and 8, mixture of two kinds of silica fine particles were used, and the values of the two kinds of silica fine particles are described in Table 2.

Organic-inorganic composite fine particles 9 were prepared according to the preparation example of "composite resin particle A" described in Japanese Patent Application Laid-Open No. 2005-202131. The physical properties of the organic-inorganic composite fine particles 1 to 9 are shown in Table 2. All of the produced organic-inorganic composite fine particles 1 to 9 had a structure including inorganic fine particles embedded to a vinyl resin particle. The surface of the organic-inorganic composite fine particle had convexes derived from the inorganic fine particles.

TABLE 2

| | Organic-inorganic composite fine particle | | | | | | | | |
|---|---|---|---|---|---|---|---|---|---|
| | 1 | 2 | 3 | 4 | 5 | 6 | 7 | 8 | 9 |
| Number-average particle diameter (nm) | 106 | 130 | 153 | 95 | 83 | 53 | 53 | 250 | 120 |
| Surface coverage ratio of organic-inorganic composite fine particle with inorganic fine particles (%) | 54 | 43 | 39 | 65 | 44 | 17 | 71 | 71 | 17 |
| Species of the inorganic fine particles | $SiO_2$ | $SiO_2$ | $SiO_2$ | $SiO_2$ | $SiO_2$ | $SiO_2$ | $SiO_2$ | $SiO_2$ | $SiO_2$ |
| Number-average particle diameter of the inorganic fine particles (nm) | 50 | 50 | 25 | 25 | 25/8 | 25/8 | 15 | 50/8 | 8 |
| Amounts of the inorganic fine particles (mass %) | 60 | 50 | 40 | 60 | 30/30 | 10/30 | 65 | 5/20 | 30 |

properties and the evaluation results of the produced magnetic toner are shown in Table 3.

Examples 2 to 11

Except that the magnetic toner particles for use and the organic-inorganic composite fine particles in Example 1 were changed as shown in Table 3, the magnetic toners were obtained by the similar external addition as in Example 1. The produced toners were evaluated in the same way as in Example 1. The physical properties and evaluation results of the produced magnetic toners were shown in Table 3.

Example 1

Magnetic toner particles 1: 100.0 parts

Organic-inorganic composite fine particles 1: 2.0 parts

Hydrophobic silica fine particles surface-treated with hexamethyl disilazane (number-average particle diameter of primary particles: 10 nm): 0.5 parts Among the raw materials, the magnetic toner particles 1 and the organic-inorganic composite fine particles 1 were mixed with an external adding and mixing apparatus 100 (a machine from FM10 made by Nippon Coke and Engineering Co., Ltd. modified as described below) as shown in FIG. 5, FIG. 6A and FIG. 6B.

The external adding and mixing apparatus 100 shown in FIG. 5 includes a processing chamber 110, a flow unit 120 for flowing the material fed into the processing chamber 110, a rotating body 130 having a processing part for processing the materials fed into the processing chamber 110, and a drive shaft 111 for mounting the flow unit 120 and the rotating body 130.

As shown in FIG. 6A and FIG. 6B, the rotating body 130 includes a processing part 132 which projects from the outer peripheral surface of a main frame 131 of the rotating body in outward radial direction so as to collide with materials for processing of the materials.

The mixture was mixed using a rotating body having the processing part 132 with a thickness of 8 mm as shown in FIG. 6B, at a rotating speed of 3,770 rpm for 2 minutes.

The hydrophobic silica fine particles surface-treated with hexamethyl disilazane was then fed into the mixture, which was mixed at a rotating speed of 3,770 rpm for 1 minute. After completion of mixing, coarse particles were removed with a mesh having an aperture size of 75 μm so as to obtain a magnetic toner.

The produced magnetic toner was measured by the above method, and the average number of pieces of the organic-inorganic composite fine particles and the coefficient of variation of the number of pieces of the organic-inorganic composite fine particles were confirmed. The produced magnetic toner was evaluated as follows. The physical Comparative Example 1

Except for the change to the use of magnetic toner particles 6 and the organic-inorganic composite fine particles 8 and the change to a rotating body having a processing part with a thickness of 4 mm of the external adding and mixing apparatus used for external addition, the magnetic toners were manufactured by the same way as in Example 1. The physical properties and evaluation results of the produced magnetic toners are shown in Table 4.

Comparative Example 2

Except for the change to the use of organic-inorganic composite fine particles 9, a toner was manufactured by the same way as in Comparative Example 1 to obtain a magnetic toner. The physical properties and evaluation results of the produced magnetic toner are shown in Table 4.

Comparative Example 3

Except that sol-gel silica particles (number-average particle diameter: 110 nm, shape factor SF-2: 100) were used as a large particle-diameter external additive, a toner was manufactured by the same way as in Comparative Example 1 to obtain a magnetic toner. The physical properties and evaluation results of the produced magnetic toner are shown in Table 4.

Comparative Example 4

In the present Comparative Example, except that the magnetic toner particles 6 and a large particle-diameter external additive of EPOSTAR S made by Nippon Shokubai Co., Ltd. (a melamine-formaldehyde condensation product, number-average particle diameter: 150 nm, shape factor SF-2: 100), which are spherical resin particles, were used, a toner was manufactured by the same way as in Comparative Example 1 to obtain a magnetic toner. The physical properties and evaluation results of the produced magnetic toner are shown in Table 4.

[Evaluation of Toner on Durability Performance, and Fusion Bonding to Component or Contamination to Component]

A laser beam printer HP LaserJet Enterprise 600 M603dn (made by Hewlett-Packard) was modified to have a process speed of 400 mm/s for use, considering a further prolonged life in the future.

A predetermined process cartridge was filled with each of the toners (magnetic toners) produced in Examples and Comparative Examples for evaluation in an amount of 1,200 g.

With a mode including printing 2 sheets of horizontal line pattern having a coverage rate of 1% per job and stopping the machine between the jobs before starting the subsequent job, a testing was performed for outputting a total of 100,000 sheets.

The image densities of the 50,000-th and 100,000-th sheet were measured and negative effects on the image due to fusion bonding to components or contamination to components were determined at the same time. The evaluation was performed under normal temperature and normal humidity environment (23° C., 50% RH).

The image density was measured with a Macbeth density meter (made by Macbeth Co.), which is a reflection densitometer, through the measurement of reflection density of a solid black image of 5 mm-circle using a SPI filter. The developability increases with an increase in the numerical value. The specific evaluation criteria were as follows. In Table 3 and Table 4, the figures between brackets are measured values.

(Evaluation Criteria)

A: 1.30 or more

B: 1.20 or more and less than 1.30

C: 1.10 or more and less than 1.20

D: less than 1.10

Negative Effects on Image Due to Fusion Bonding to Components

The negative effects on the image due to fusion bonding to components were evaluated based on the degree of vertical streaks on the solid black image outputted at the same timing for checking the image density.

The occurrence of vertical streaks is a phenomenon caused by fusion bonding of the toner to the surface of a development sleeve during a long period endurance, resulting in no charging and no development at the fusion bonded region. The specific evaluation criteria were as follows.

(Evaluation Criteria)

A: No vertical streak was observed.

B: Vertical streaks were slightly observed in the end regions of an image.

C: Fine vertical streaks were observed.

D: Bold vertical streaks were observed.

Negative Effects on Image Due to Contamination to Components

The negative effects on the image due to contamination to components were evaluated based on the image defect degree of white spots on the solid black image outputted at the same timing for checking the image density.

The image defect with white spots is a phenomenon caused by the detachment of external additives during a long period endurance so as to form aggregates on an electrostatic latent image support, resulting in no development of toner at the regions. The specific evaluation criteria were as follows. In Table 3 and Table 4, the figures between brackets are the number of pieces of the image defects.

(Evaluation Criteria)

A: No image defect with white spot was observed.

B: The number of occurrence of image defects with white spots was less than 5.

C: The number of occurrence of image defects with white spots was 5 or more and less than 10.

D: The number of occurrence of image defects with white spots was 10 or more.

TABLE 3

| | Example | | | | | |
|---|---|---|---|---|---|---|
| | 1 | 2 | 3 | 4 | 5 | 6 |
| Magnetic toner particle No. | 1 | 2 | 3 | 4 | 5 | 5 |
| Large particle-diameter external additive No. (Organic-inorganic composite fine particle) | 1 | 1 | 1 | 1 | 1 | 2 |
| Average number of pieces of organic-inorganic composite fine particles | 165 | 150 | 136 | 124 | 113 | 102 |
| Coefficient of variation of number of pieces of organic-inorganic composite fine particles | 0.12 | 0.13 | 0.15 | 0.16 | 0.18 | 0.19 |
| Number-average particle diameter of large particle-diameter external additive observed at surface of toner particle (nm) | 106 | 106 | 106 | 106 | 106 | 159 |
| Shape factor SF-2 of large particle-diameter external additive observed at surface of toner particle | 116 | 116 | 116 | 116 | 116 | 117 |

TABLE 3-continued

| | | | | | | | |
|---|---|---|---|---|---|---|---|
| Surface coverage ratio of large particle-diameter external additive with inorganic fine particles (%) | | 54 | 54 | 54 | 54 | 54 | 43 |
| Evaluation | Image density | A (1.35) | A (1.34) | A (1.33) | A (1.32) | B (1.28) | B (1.26) |
| | Fusion boding to component | A | A | A | B | A | B |
| | Contamination to component | A (0) | A (0) | A (0) | A (0) | A (0) | B (2) |

| | Example | | | | |
|---|---|---|---|---|---|
| | 7 | 8 | 9 | 10 | 11 |
| Magnetic toner particle No. | 5 | 5 | 5 | 5 | 5 |
| Large particle-diameter external additive No. (Organic-inorganic composite fine particle) | 3 | 4 | 5 | 6 | 7 |
| Average number of pieces of organic-inorganic composite fine particles | 93 | 85 | 77 | 72 | 70 |
| Coefficient of variation of number of pieces of organic-inorganic composite fine particles | 0.21 | 0.23 | 0.26 | 0.28 | 0.29 |
| Number-average particle diameter of large particle-diameter external additive observed at surface of toner particle (nm) | 190 | 99 | 71 | 62 | 62 |
| Shape factor SF-2 of large particle-diameter external additive observed at surface of toner particle | 108 | 104 | 108 | 104 | 104 |
| Surface coverage ratio of large particle-diameter external additive with inorganic fine particles (%) | 39 | 65 | 44 | 17 | 71 |
| Evaluation Image density | B (1.26) | B (1.24) | B (1.21) | C (1.15) | C (1.12) |
| Fusion boding to component | C | C | B | B | C |
| Contamination to component | B (3) | C (7) | B (4) | C (8) | B (4) |

TABLE 4

| | Comparative Example | | | |
|---|---|---|---|---|
| | 1 | 2 | 3 | 4 |
| Magnetic toner particle No. | 6 | 6 | 6 | 6 |
| Large particle-diameter external additive No. (Organic-inorganic composite fine particle) | 8 | 9 | Sol-gel silica | EPOSTAR S |
| Average number of pieces of organic-inorganic composite fine particles | 58 | 64 | 53 | 48 |
| Coefficient of variation of number of pieces of organic-inorganic composite fine particles | 0.35 | 0.39 | 0.54 | 0.62 |
| Number-average particle diameter of large particle-diameter external additive observed at surface of toner particle (nm) | 335 | 120 | 110 | 150 |
| Shape factor SF-2 of large particle-diameter external additive observed at surface of toner particle | 106 | 100 | 100 | 100 |
| Surface coverage ratio of large particle-diameter external additive with inorganic fine particles (%) | 71 | 17 | 0 | 17 |
| Evaluation Image density | D (1.09) | D (1.09) | D (1.07) | D (1.05) |
| Fusion boding to component | D | D | D | D |
| Contamination to component | D (12) | D (12) | D (14) | D (15) |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-158912, filed Jul. 31, 2013, which is hereby incorporated by reference herein in its entirety.

What is claimed is:

1. A toner, comprising:

a toner particle having an average circularity of 0.935 to 0.948, said toner particle comprising a binder resin, a magnetic material having an octahedral shape with a number average particle diameter ranging from 100 to 200 nm, and organic-inorganic composite fine particles, said organic-inorganic composite fine particles comprising vinyl resin particles with a number average particle diameter of 50 to 200 nm and a shape factor SF-2 of 103 to 120 having inorganic fine particles embedded to the vinyl resin particle, the organic-inorganic composite fine particles having convexes derived from the inorganic fine particles on surfaces thereof, wherein (i) each of the eight regions of the first circle comprises pieces of the magnetic material, and an average number of the pieces of the magnetic material contained in each of the eight regions of the first circle is 6.0 or more and a coefficient of variation of the number of the pieces of the magnetic material among the eight regions of the first circle is 0.50 or less when drawing a first circle on a reflection electron image of the toner particle, the reflection electron image being photographed by using a scanning electron microscope with a magnifying power of 20,000, the first circle having a radius of 2.0 μm, and having a center at a midpoint of the maximum diameter of the toner particle in the reflection electron image, and dividing the first circle into eight regions evenly with eight lines each of which extends from the center of the first circle towards a periphery of the first circle, and (ii) each of the eight regions of the second circle comprises the organic-inorganic composite fine particles, an average number of the organic-inorganic composite fine particles contained in each of the eight regions of the second circle is 70.0 or more, and a coefficient of variation of the number of the organic-inorganic composite fine particles among the eight regions of the second circle is 0.30 or less when drawing a second circle on a reflection electron image of the toner, the reflection electron image being photographed by using a scanning electron microscope with a magnifying power of 20,000, the second circle having a radius of 2.0 μm, and having a center at a midpoint of the maximum diameter of the toner in the reflection electron image, and dividing the second circle into eight regions evenly with eight lines each of which extends from the center of the second circle towards a periphery of the second circle.

2. The toner according to claim 1, wherein the surfaces of the organic-inorganic composite fine particles are covered with the inorganic fine particles to have a coverage ratio of 20 to 70%.

3. The toner according to claim 1, wherein the coefficient of variation of the number of the pieces of the magnetic material is 0.26 or less.

4. The toner according to claim 1, wherein the average number of the pieces of the magnetic material contained in each of the eight regions of the first circle is 6.0 to 18.0.

5. The toner according to claim 1, wherein the average number of the organic-inorganic composite fine particles contained in each of the eight regions of the second circle is 70.0 to 340.0.

6. The toner according to claim 1, wherein the average number of the organic-inorganic composite fine particles contained in each of the eight regions of the second circle is 70.0 to 180.0.

7. The toner according to claim 1, wherein the amount of the magnetic material contained in the toner particle is 45 to 95 parts by mass based on 100 parts by mass of the binder resin.

8. The toner according to claim 1, wherein the amount of the organic-inorganic composite fine particles contained in the toner is 0.5 to 4.0 parts by mass based on 100 parts by mass of the toner particle.

* * * * *